US009498099B2

(12) United States Patent
Shinler et al.

(10) Patent No.: US 9,498,099 B2
(45) Date of Patent: Nov. 22, 2016

(54) SURFACE MAINTENANCE VEHICLE WITH COMPACT SIDE BRUSH ASSEMBLY

(71) Applicant: Tennant Company, Minneapolis, MN (US)

(72) Inventors: Kevin L. Shinler, Minnetonka, MN (US); Richard W. Wellens, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 301 days.

(21) Appl. No.: 13/767,867

(22) Filed: Feb. 14, 2013

(65) Prior Publication Data

US 2013/0212814 A1 Aug. 22, 2013

Related U.S. Application Data

(60) Provisional application No. 61/599,771, filed on Feb. 16, 2012.

(51) Int. Cl.

| | |
|---|---|
| ***A47L 11/28*** | (2006.01) |
| ***A47L 11/24*** | (2006.01) |
| ***A47L 11/29*** | (2006.01) |
| ***A47L 11/40*** | (2006.01) |

(52) U.S. Cl.
CPC ..... *A47L 11/24* (2013.01); *A47L 11/28* (2013.01); *A47L 11/29* (2013.01); *A47L 11/4038* (2013.01); *A47L 11/4055* (2013.01)

(58) Field of Classification Search
CPC ..... A47L 11/00; A47L 11/293; A47L 11/4038; A47L 11/4061; A47L 11/28; A47L 11/29
USPC ..... 15/49.1, 50.1, 87, 98
See application file for complete search history.

(56) References Cited

U.S. PATENT DOCUMENTS

| | | | | |
|---|---|---|---|---|
| 3,316,578 | A * | 5/1967 | Tamny | 15/87 |
| 3,790,981 | A * | 2/1974 | Young | 15/87 |
| 4,084,285 | A * | 4/1978 | Herzog | E01H 1/053 15/87 |
| 4,368,554 | A * | 1/1983 | Mealing et al. | 15/354 |
| 4,691,402 | A * | 9/1987 | Veselka | E01H 1/053 15/87 |

(Continued)

FOREIGN PATENT DOCUMENTS

| | | |
|---|---|---|
| DE | 4001088 A1 | 7/1991 |
| EP | 0021784 A1 | 1/1981 |

(Continued)

OTHER PUBLICATIONS

International Preliminary Report on Patentability for International Application No. PCT/US2013/026247, Aug. 19, 2014, 8 pages.

*Primary Examiner* — Michael Jennings
(74) *Attorney, Agent, or Firm* — Fredrikson & Byron, P.A.

(57) ABSTRACT

A surface maintenance vehicle with a compact side brush assembly. The side brush assembly includes a brush deck, a parallel linkage assembly, a swing arm, and an actuator assembly. The brush deck carries a floor-engaging brush. The parallel linkage assembly permits pivoting of the brush deck about a lift axis to raise and lower the brush deck. The swing arm is adapted to rotates to swing the brush deck towards and away from the floor surface maintenance machine. The actuator assembly includes a linear actuator and a slip link.

29 Claims, 16 Drawing Sheets

(56) References Cited

U.S. PATENT DOCUMENTS

| | | | | |
|---|---|---|---|---|
| 5,016,310 | A | 5/1991 | Geyer et al. | |
| 5,922,968 | A | 7/1999 | Briscoe | |
| 8,769,755 | B2 * | 7/2014 | Hetler | E01H 1/053 15/49.1 |
| 2002/0170130 | A1 * | 11/2002 | Shinler | A47L 11/16 15/49.1 |
| 2002/0170131 | A1 * | 11/2002 | Shinler | A47L 11/16 15/49.1 |
| 2010/0291843 | A1 * | 11/2010 | Strickland | A47L 11/16 451/350 |
| 2011/0107529 | A1 * | 5/2011 | Hetler | E01H 1/053 15/21.1 |
| 2013/0212813 | A1 * | 8/2013 | Shinler | A47L 11/28 15/4 |

FOREIGN PATENT DOCUMENTS

| | | | |
|---|---|---|---|
| EP | 0795647 | A1 | 9/1997 |
| WO | 2011057253 | A1 | 5/2011 |

* cited by examiner

SURFACE MAINTENANCE VEHICLE WITH COMPACT SIDE BRUSH ASSEMBLY

PRIORITY CLAIM

The present application claims priority to U.S. Provisional Patent Application Ser. No. 61/599,771, filed Feb. 16, 2012, the disclosure of which is hereby incorporated by reference in its entirety.

FIELD OF THE INVENTION

The present invention generally relates to floor surface cleaning equipment. More particularly the present invention relates to a compact side brush assembly for use with such equipment.

BACKGROUND OF THE INVENTION

Surface maintenance vehicles and cleaning devices have a long history subject to gradual innovation and improvement toward improved and oftentimes automated performance in removing debris and contamination from floors. These vehicles and devices may be self-powered, towed, or pushed, and/or manually powered and may carry a human operator during cleaning operations. Such vehicles and devices include scrubbers, extractors, sweepers and vacuums, as well as combinations thereof, intended for cleaning, scrubbing, wiping and/or drying a portion of a substantially flat surface both indoors and outdoors. Many such vehicles and devices employ a side brush assembly for accessing a larger floor envelope. Such side brush assemblies make it easier to clean near walls or other obstacles without damaging the machine or the wall while at the same time widening the cleaning path of the machine to increase productivity measured as area cleaned divided by time.

The side brush assembly of such prior art cleaning vehicles often mounts at or near the side of a surface maintenance vehicle and swings outwardly away from a machine center and downwardly toward the surface to be cleaned. A lift motion of the side brush assembly is desired to raise the brush deck to provide ground clearance when the scrubbing functions are turned off. An extension/retraction motion is desired to extend the deck past the machine envelope when operating, and to retract the deck back when not operating the side brush. Portions of the side brush assembly retracted behind the machine frame are protected from damage.

Some prior art side brush assemblies have included a large number of parts, which can increase the cost and complexity of such assemblies. In addition, some prior art side brush assemblies have a large footprint on the surface maintenance vehicle that can complicate packaging the side brush assembly within the confines of the vehicle. In addition, the packaging considerations of a relatively large side brush assembly make it difficult to use the same side brush assembly design on different vehicles of different sizes.

SUMMARY

Certain embodiments of the invention include a side brush assembly for a floor surface maintenance machine where the side brush assembly includes a brush deck, a parallel linkage assembly, a swing arm, and an actuator assembly. The brush deck carries a floor-engaging brush. The parallel linkage assembly supports the brush deck generally parallel to the floor surface and permits pivoting of the brush deck about a lift axis to raise and lower the brush deck. The swing arm is adapted to rotate about a pivot axis and is connected to the parallel linkage assembly. The pivoting of the swing arm about its pivot axis swings the brush deck towards and away from the floor surface maintenance machine. The actuator assembly includes a linear actuator and a slip link. When actuated, the actuator assembly pivots the parallel linkage assembly about the lift axis and pivots the swing arm about its pivot axis to move the brush deck to a transport mode or an operational mode.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

Figure 1A:
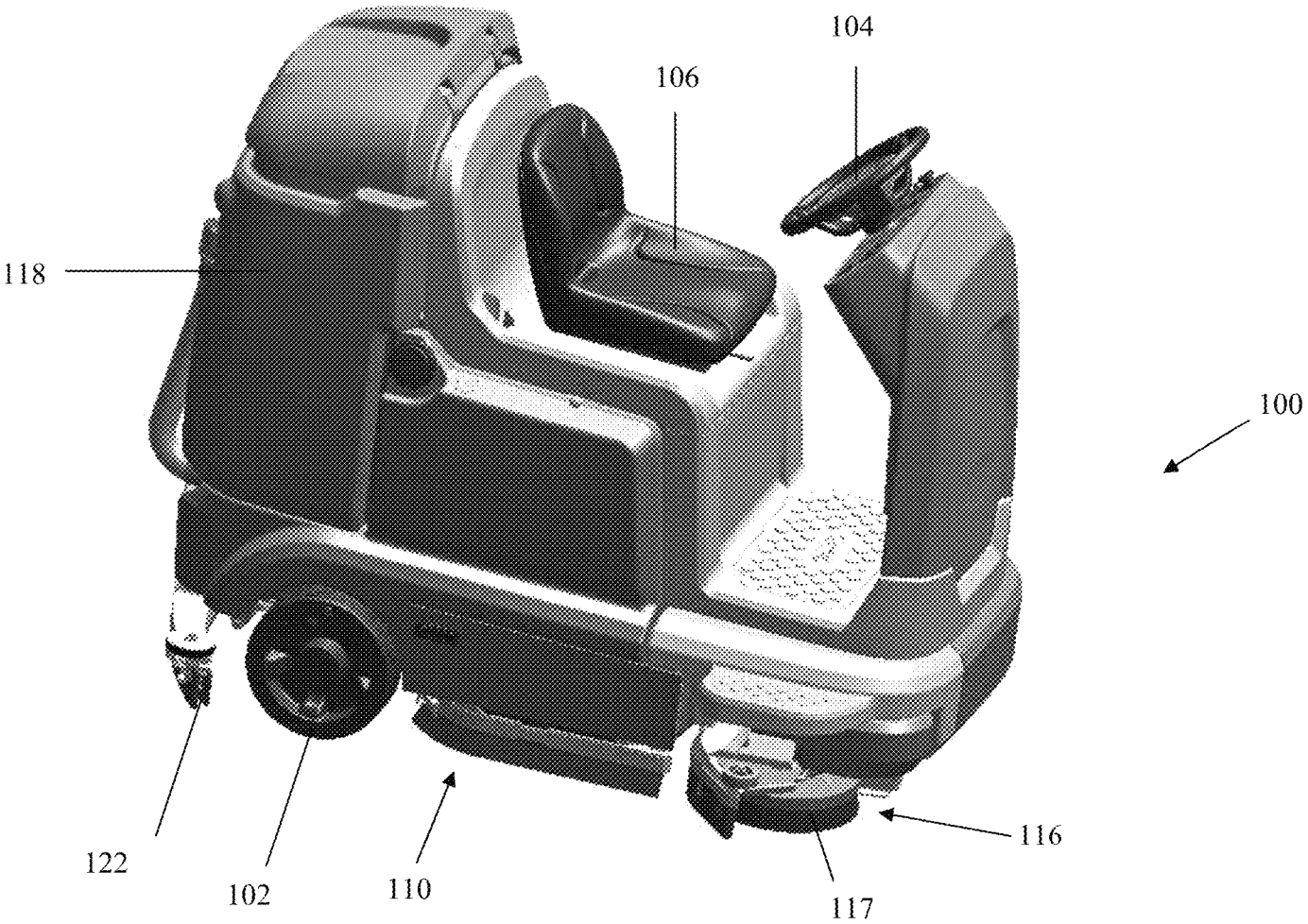
FIG. 1A is an upper perspective view of an exemplary floor surface cleaning machine employing an embodiment of the compact side brush assembly of the present invention shown in the operational mode.
Figure 1B:
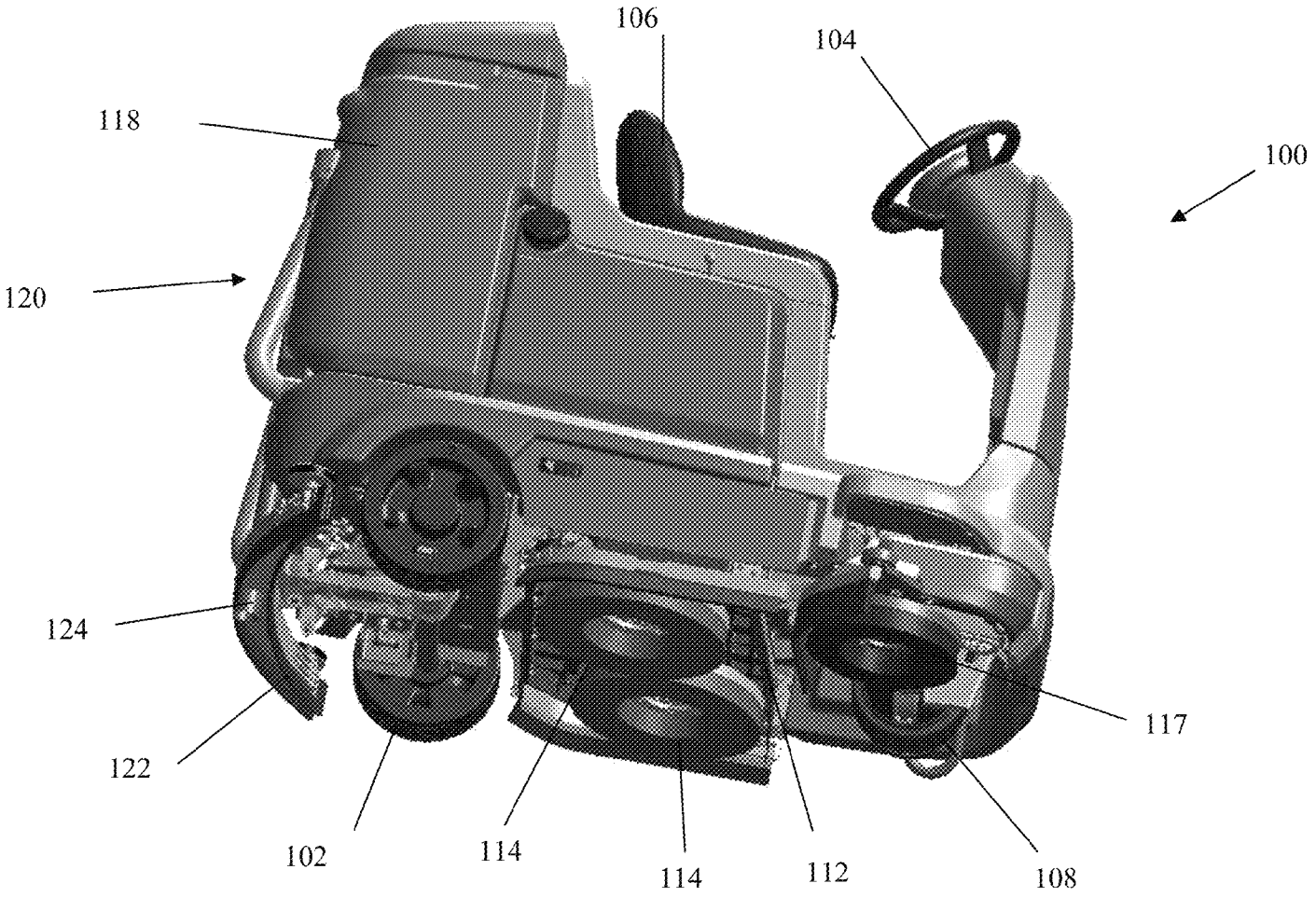
FIG. 1B is a lower perspective view of an exemplary floor surface cleaning machine employing the embodiment of the compact side brush assembly of FIG. 1A shown in the operational mode.

FIGS. 1A-B are upper and lower perspective views, respectively, of an exemplary floor surface cleaning machine 100. Embodiments of the machine 100 include components that are supported on a motorized mobile body. The mobile body comprises a frame supported on wheels 102 for travel over a surface, on which a cleaning operation is to be performed. The mobile body includes operator controls and a steering wheel 104, which is positioned with respect to a seat 106 of machine 100, so that a seated operator of machine 100 may steer a front center wheel 108 of machine 100. Machine 100 is preferably powered by one or more batteries that may be contained in a compartment beneath the seat. Alternately, the power source may be an internal combustion engine, powered through an electrical cord, or one or more power cells, may be employed to power machine 100.

Cleaning components extend from an underside of the machine 100. For example, a scrub head 110 is shown located at a middle portion of machine 100. The scrub head 110 has a housing 112 that encloses two scrub brushes 114. The brushes 114 are driven by two electric motors. An electric actuator attached between the scrub head 110 and the housing 112 raises the scrub head 110 for transport, lowers it for work, and controls its down pressure on the floor. Additional aspects of the electric actuator and associated mechanical coupling are described in more detail hereinafter. The scrub head 110 uses two disk scrub brushes 114 rotating about parallel vertical axes. Alternatively, scrub heads may be made with only one disk scrub brush, or one or more cylindrical brushes rotating about horizontal axes. While a scrub head 110 is depicted in the drawing figures, any appliance or tool for providing surface maintenance, surface conditioning, and/or surface cleaning to a surface may be coupled to an associated machine or vehicle in accordance with the present invention.

Vehicle 100 includes a side brush assembly generally indicated as 116 for cleaning a larger floor envelope. Such side brush assemblies make it easier to clean near walls or other obstacles without damaging the machine or the wall while at the same time widening the cleaning path of the machine to increase productivity. The side brush assembly is mounted on the front, right side of machine 100 and swings outwardly away from the machine center and downwardly toward the surface to be cleaned. In FIGS. 1A and 1B, the side brush assembly 116 in the "down-and-out" mode, e.g., operational mode, where the side brush 117 is pivoted "down" against the floor surface and pivoted "out" away from the machine center to widen the cleaning path of vehicle 100. As described further below, the side brush assembly 116 may also be placed in the "up-and-in" mode, e.g., its storage and/or inactive transportation mode, where the side brush 117 is pivoted "up" away from the underlying floor surface and pivoted "in" in towards the vehicle 100 center to store and protect the side brush 117 during periods when it is not in use.

During wet scrubbing operations, water or a cleaning liquid contained in a tank 118 is sprayed to the surface beneath machine 100, in proximity to the scrub head 110. Brushes 114 scrub the surface and the soiled cleaning liquid is then collected by a fluid recovery system and deposited in a waste recovery tank 120. One embodiment of the fluid recovery system of the machine 100 includes a vacuum squeegee mounted adjacent the rear end of the machine 100. The vacuum squeegee generally comprises a squeegee 122 that extends across the width of the machine 100 and a frame that supports the squeegee 122. The vacuum squeegee also includes a vacuum port 124 that is placed in vacuum communication with a vacuum fan. The vacuum fan operates to remove liquid and particle waste collected by the vacuum squeegee 122 for deposit in the waste recovery tank 120.

In alternate embodiments, the floor surface maintenance machines 100 may be combination sweeper and scrubber machines. In such embodiments, in addition to the elements describe above, the machines 100 may also include sweeping brushes and a hopper extending from the underside of the machine 100, with the sweeping brushes designed to direct dirt and debris into the hopper. In still other embodiments, the machine 100 may be a sweeper only. In such embodiments, the machine 100 may include the elements as described above for a sweeper and scrubber machine, but would not include the scrubbing elements such as scrubbers, squeegees and fluid storage tanks (for detergent, recovered fluid and clean water). Alternatively, the machine 100 may be designed for use by an operator that walks behind the machine, or the machine may be configured to be towed behind a vehicle. Machine 100 may also be a zero turn radius vehicle and it may have steerable front or rear wheels.

Figure 2A:
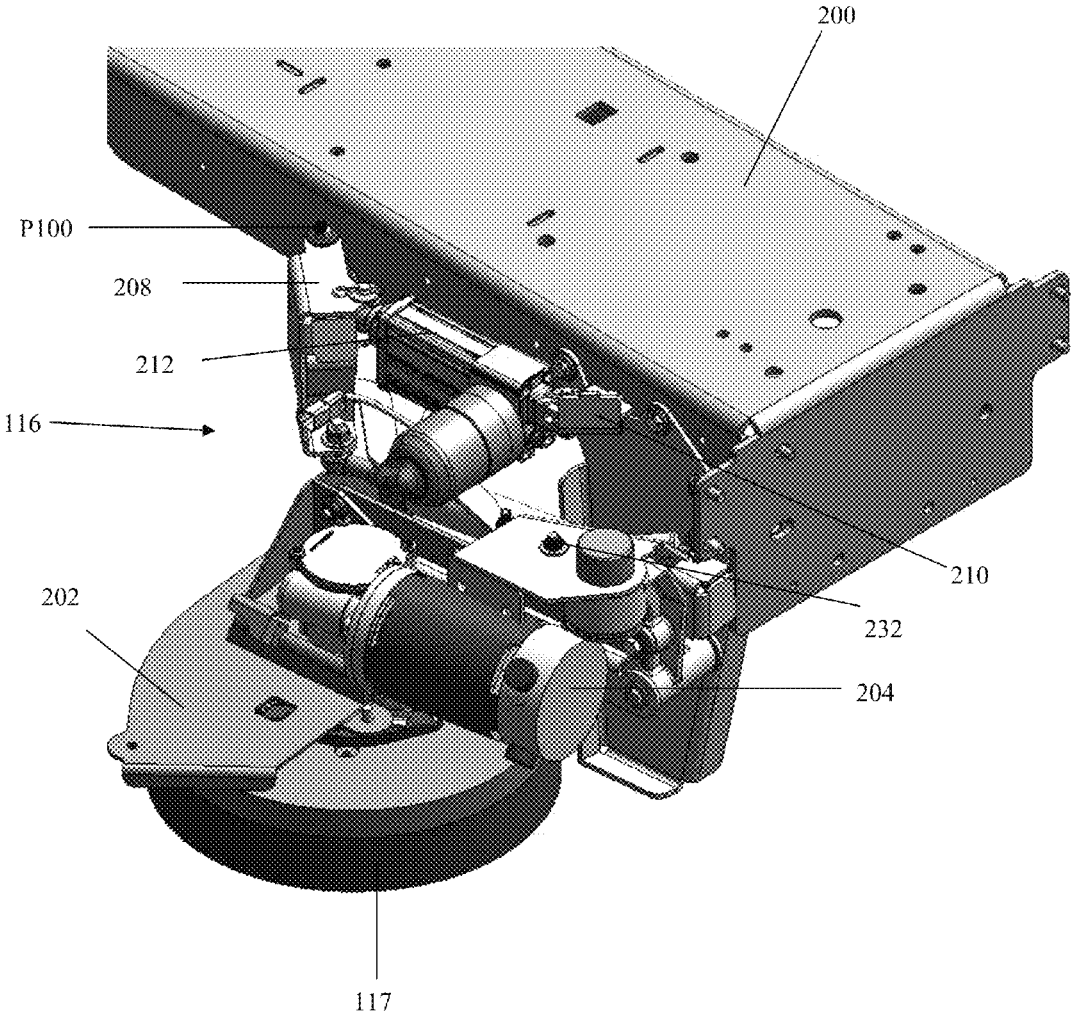
FIG. 2A is an upper right side perspective view of a frame of the machine of FIG. 1 and a portion of an embodiment of the compact side brush assembly of the present invention shown in the transport mode.

FIG. 2A is an upper right side perspective view of a frame 200 of the machine 100 of FIG. 1 and the compact side brush assembly 116, shown in the transport mode. Side brush assembly 116 includes a brush deck 202 having a floor brush 117 driven by an electric-powered motor 204 for engaging a floor surface during side brush assembly 116 operation. The side brush assembly 116 includes a suspension and lift mechanism, described further below, for extending the side brush assembly 116 outwardly, away from a machine centerline, and for lowering brush 117 into floor surface contact. The suspension and lift mechanism 206 is attached to the frame 200 by different components, including a frame bracket 208 that pivots about frame 200 via a vertical pivot axis P100 and including a frame mount 210 that connects to a linear actuator 212 of the suspension and lift mechanism 206. Activation of the linear actuator 212 is preferably achieved through a switch accessible at a user control panel. Side brush assembly 116 is designed to "float" relative to machine 100, thereby keeping brush 117 in contact with the surface being cleaned even if the surface is somewhat irregular or uneven.

Figure 2B:
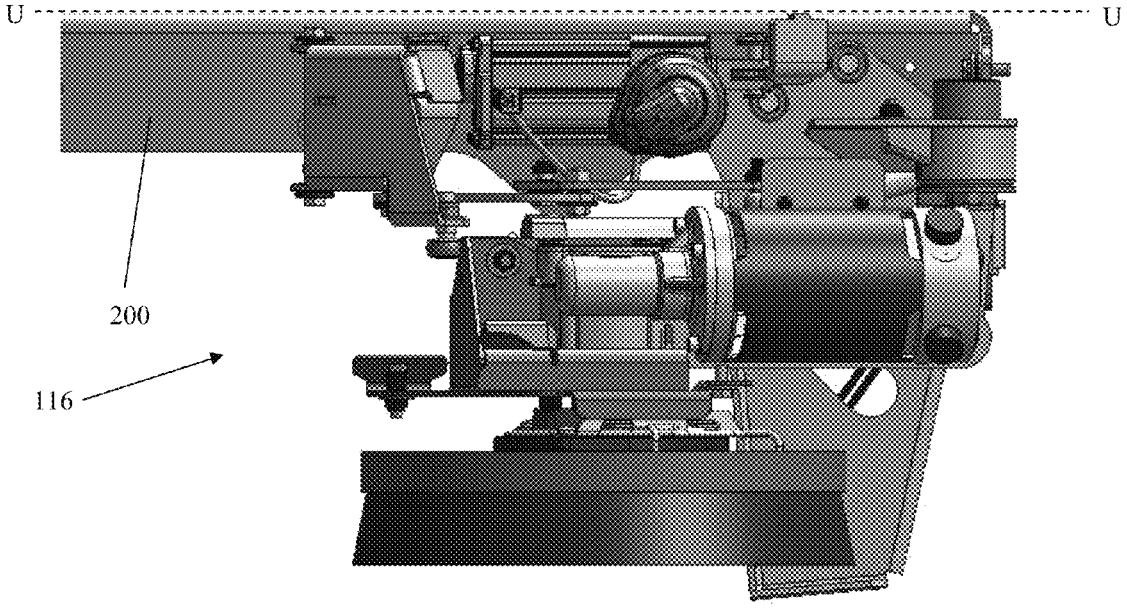
FIG. 2B is a right side elevation view of the embodiment shown in FIG. 2A.
Figure 2C:
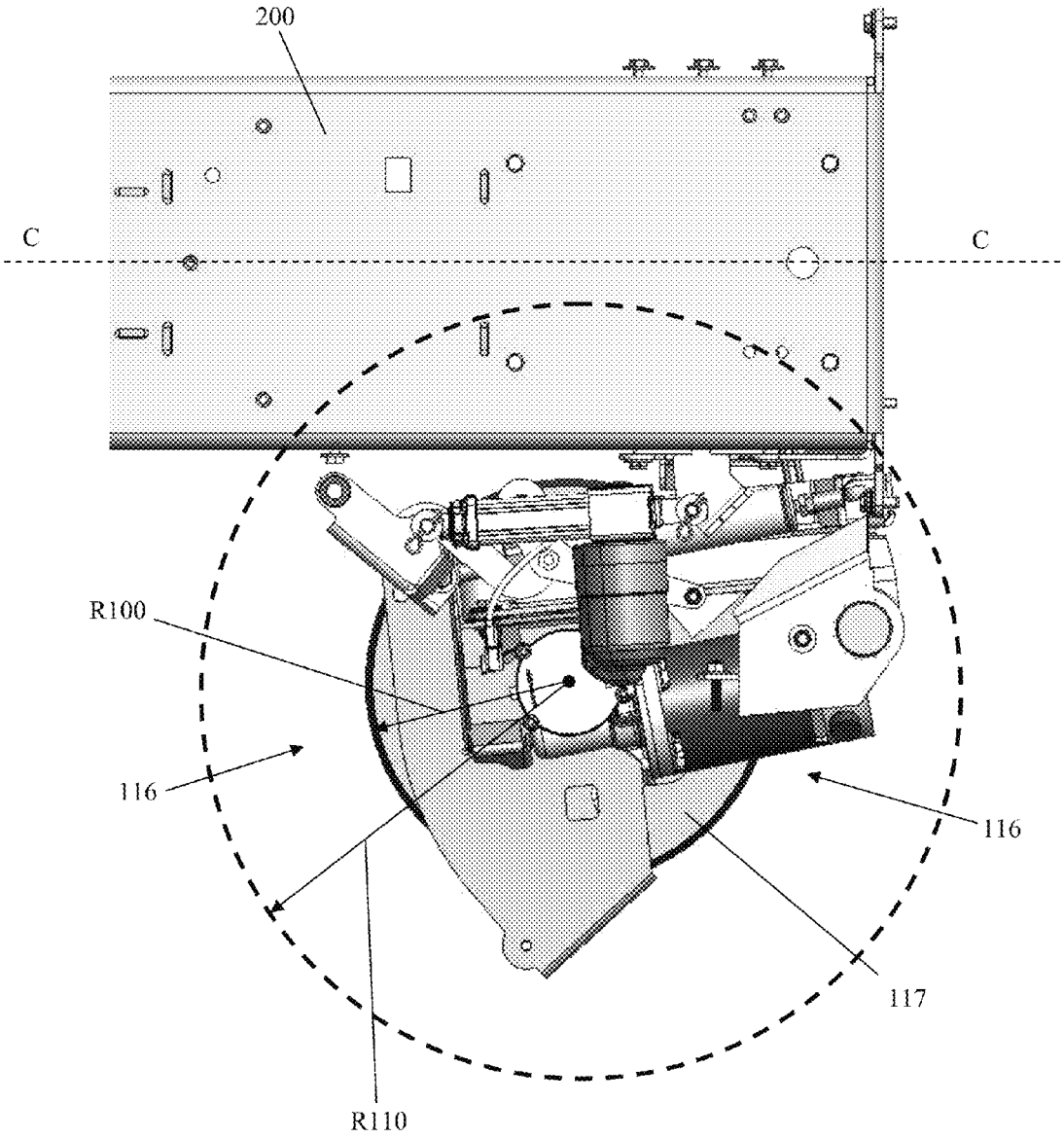
FIG. 2C is a top plan view of a frame of the embodiment shown in FIG. 2A.

Embodiments of the compact side brush assembly 116 provide for small footprint under the surface maintenance vehicle that simplifies packaging the side brush assembly 116 within the confines of the vehicle 100. FIG. 2B is a right side elevation view of the embodiment shown in FIG. 2A. FIG. 2C is a top plan view of a frame of the embodiment shown in FIG. 2A. Frame 200 extends longitudinally and has a cross-section in the shape of an inverted-U. Although other frame elements are bolted, welded, or otherwise connected to frame 200, frame 200 has a major top surface that is generally planar. As shown in FIG. 2B, all the components of the side brush assembly 116 are positioned at a height lower than the dotted line designated at U, the generally horizontal plane that intersects the major top surface of the frame 200. Accordingly, in certain embodiments, side brush assembly 116 is compact in that it does not extend higher than the major top surface of the vehicle frame 200.

As shown in FIG. 2C, vehicle 100 has a longitudinal centerline shown as a dotted line C. As may be seen in FIG. 2C, all the components of the side brush assembly 116 are located to the right side of the longitudinal centerline C. In alternate embodiments, all of the components of the side brush assembly are located to the left side of the longitudinal centerline C. In either embodiment, side brush assembly 116 is compact in that it is restricted to just one side, right or left, of the vehicle 100. Frame 200 is internal and may be considered as a spine frame, but it can be formed in many different manners besides with an inverted U-shape. Many frames, besides just one have an inverted-U shape have a major surface spanning an upper portion of the frame.

The side brush assembly 116 is positioned proximate to the brush 117. FIG. 2C also shows that brush 117 is generally cylindrical with a radius designated as R100. In certain embodiments, brush 117 has a 13 inch diameter that, when in the operational position, adds about 10 inches to the width of the scrub path of the vehicle 100. Accordingly, in such embodiments, the radius R100 is about 6.5 inches. The side brush assembly 116 is generally centrally above brush 117. As shown in FIG. 2C, when in the transport mode, the entire side brush assembly is confined to a circular area having a radius R110, where the radius R110 is measured from the center point of brush 117. In some embodiments, R110 is about 2 times as large as R100. In other embodiments, R110 is less than 2.5 times as large as R100.

Figure 3A:
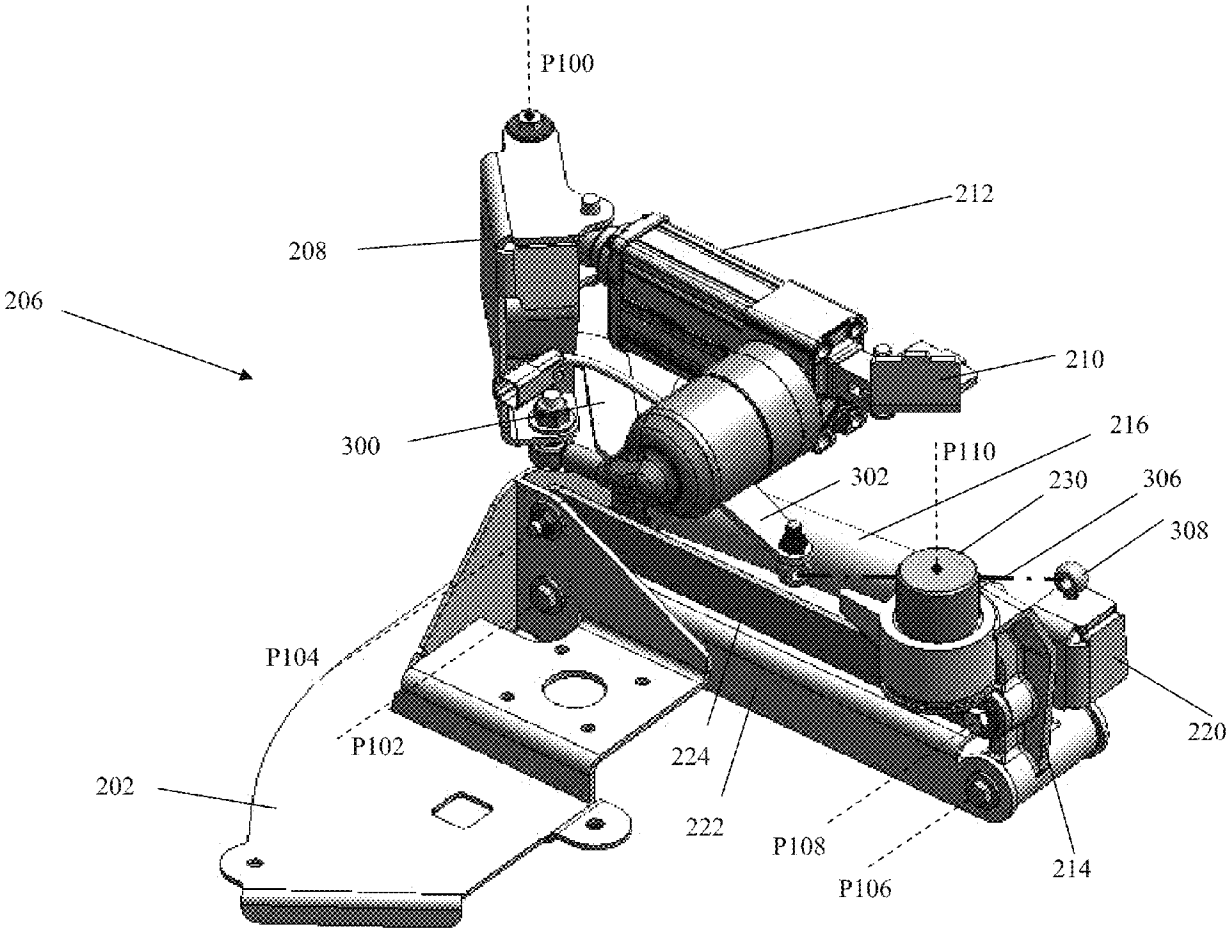
FIG. 3A is an upper right side perspective view of a portion of an embodiment of the compact side brush assembly of the present invention shown in the transport mode.
Figure 3B:
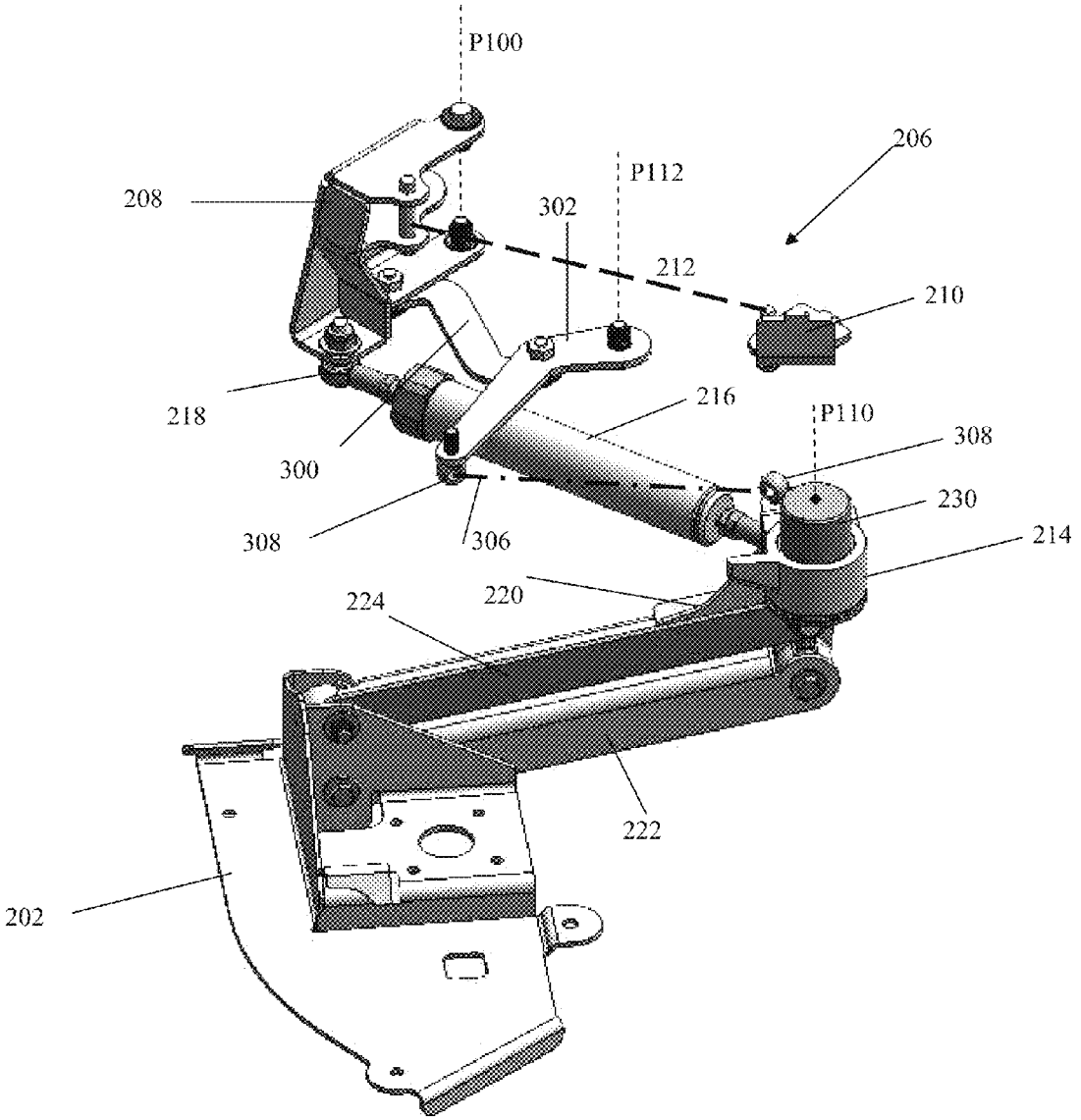
FIG. 3B is an upper right side perspective view of the portion of the embodiment of the compact side brush assembly of FIG. 3A shown in the operational mode.

FIG. 3A is an upper right side perspective view of a portion of an embodiment of the suspension and lift mechanism 206 of the compact side brush assembly of the present invention shown in the transport mode. Several components of the compact side brush assembly 116, such as the brush 117 and brush motor 204, and the frame 200, have been omitted to more clearly show the suspension and lift mechanism 206. FIG. 3B is an upper right side perspective view of the portion of the embodiment of the compact side brush assembly 116 of FIG. 3A, but shown in the operational mode. To provide added clarity, the linear actuator 212 of the suspension and lift mechanism 206 of FIG. 3A has been replaced with a dotted line in FIG. 3B.

Figure 4A:
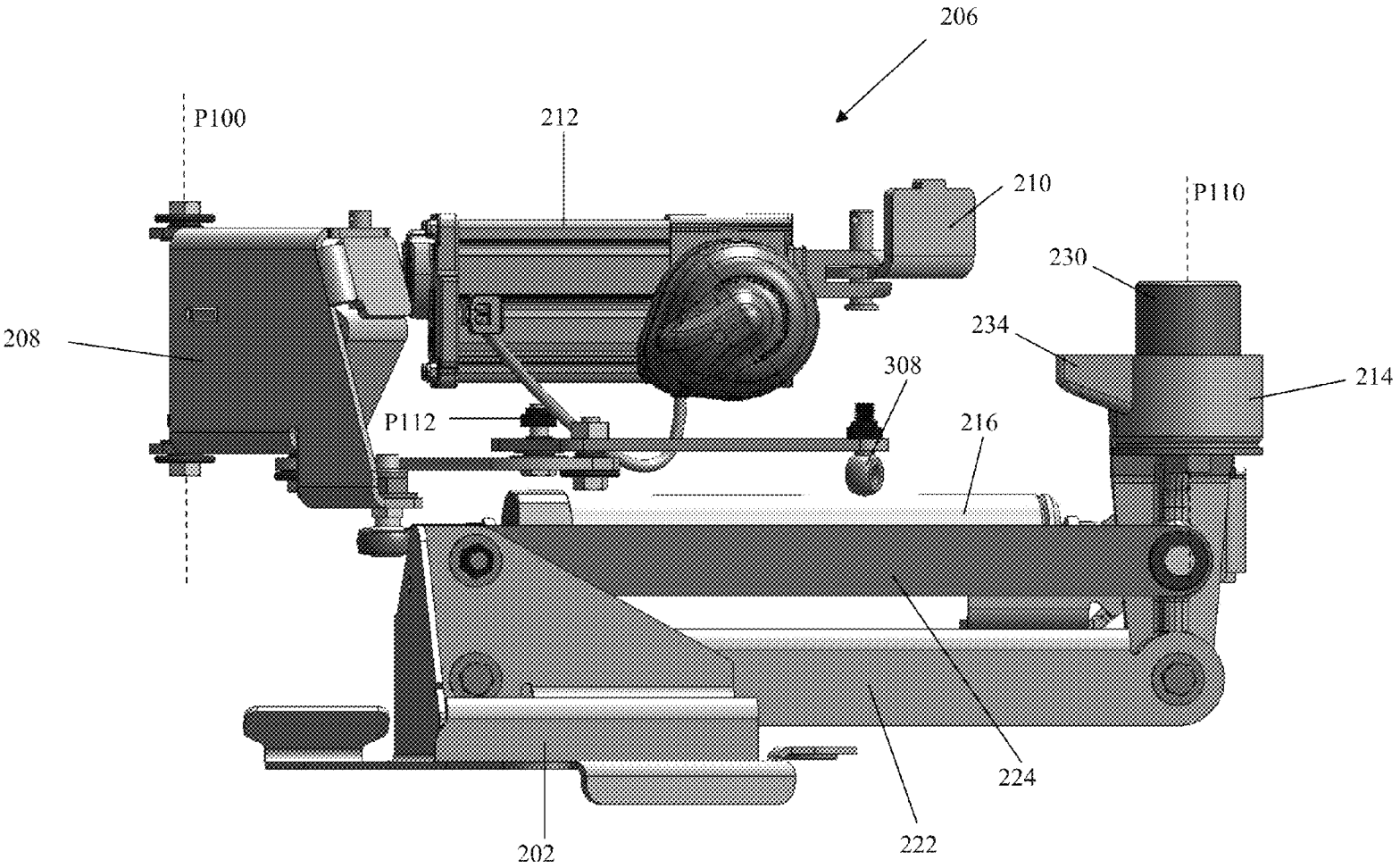
FIG. 4A is a right side elevation view of a portion of the embodiment of the compact side brush assembly of FIG. 3B shown in the transport mode.
Figure 4B:
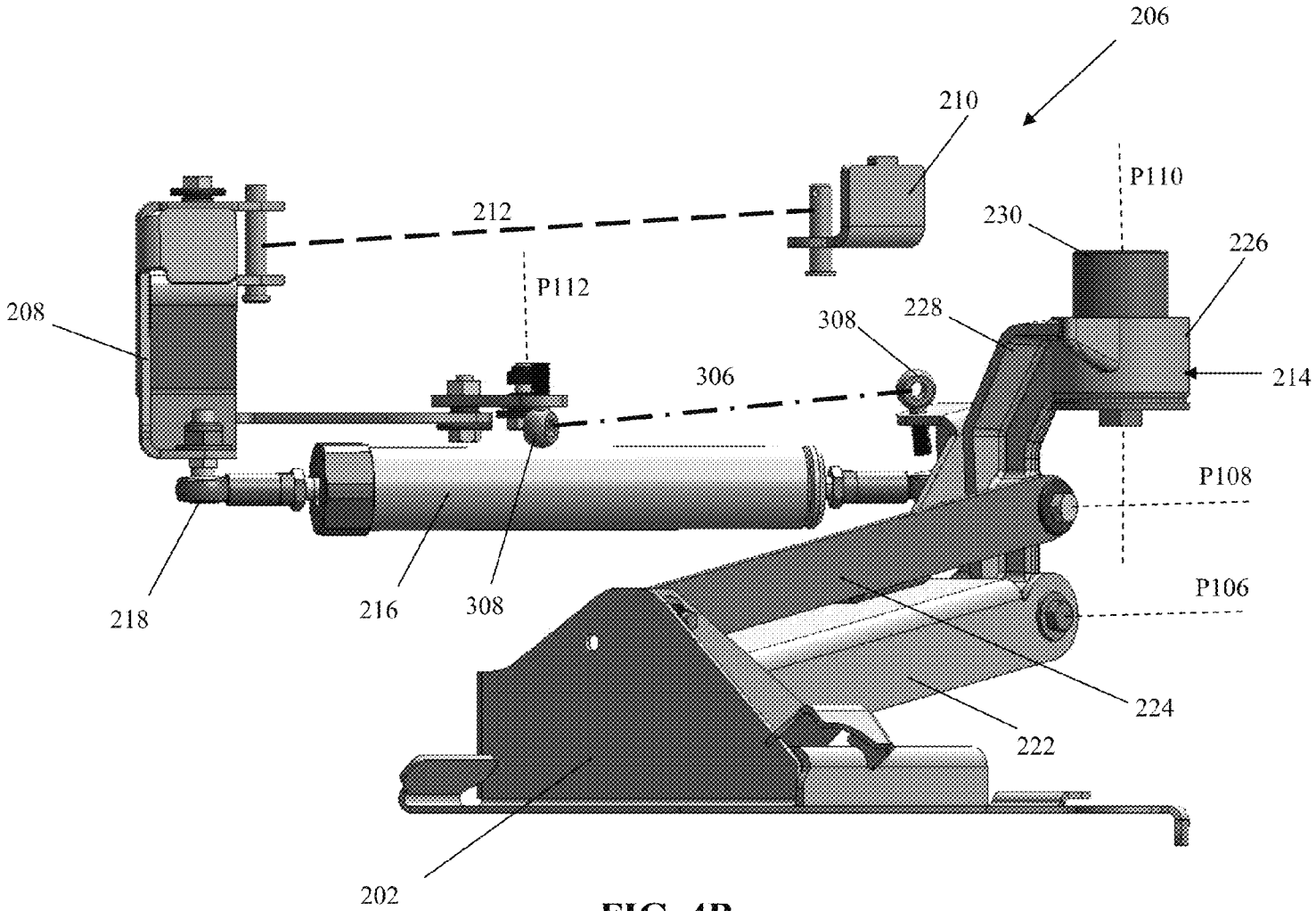
FIG. 4B is a right side elevation view of a portion of the embodiment of the compact side brush assembly of FIG. 3B shown in the operational mode.
Figure 5A:
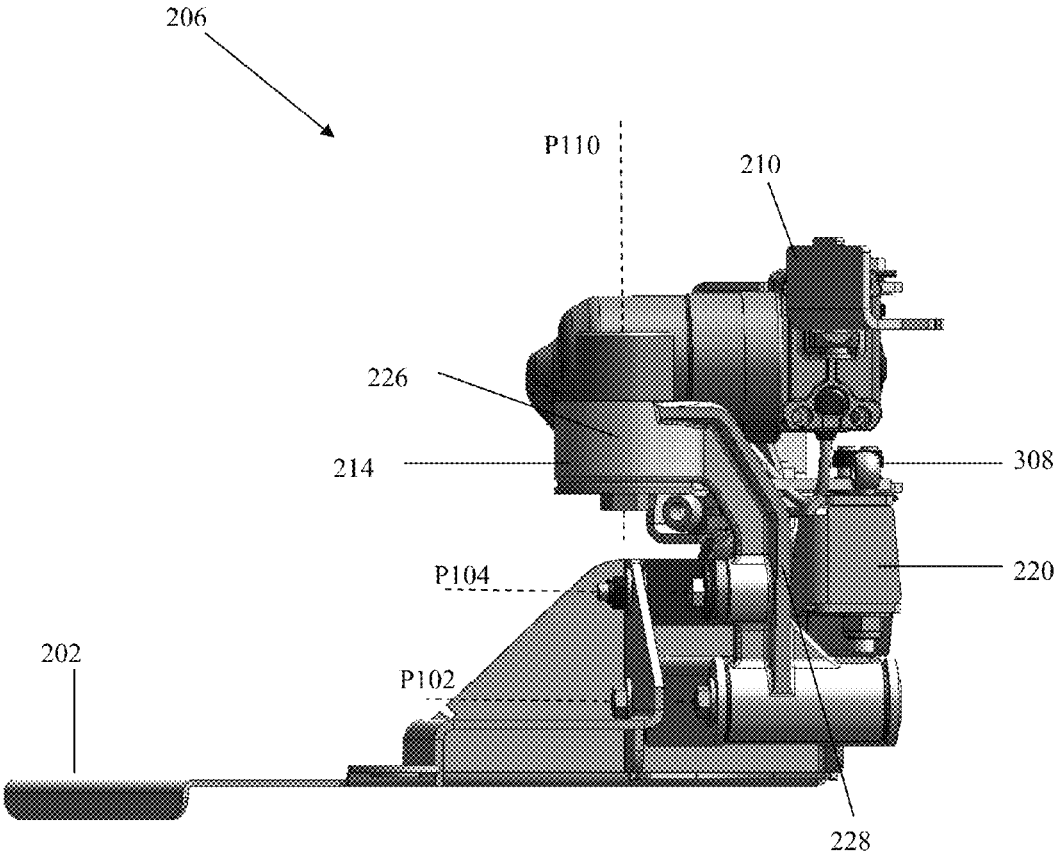
FIG. 5A is a front elevation view of a portion of the embodiment of the compact side brush assembly of FIG. 3B shown in the transport mode.
Figure 5B:
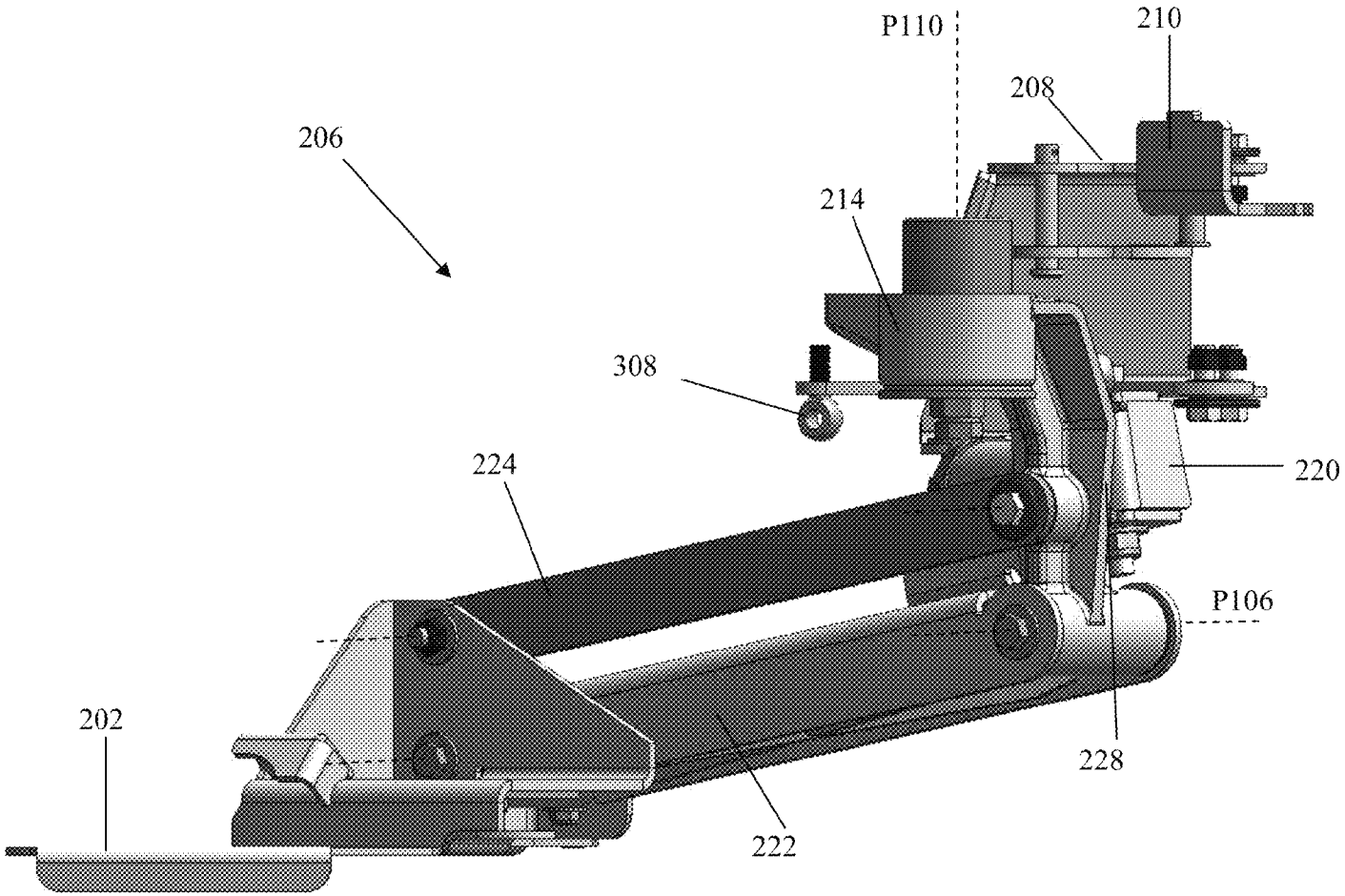
FIG. 5B is a front elevation view of a portion of the embodiment of the compact side brush assembly of FIG. 3B shown in the operational mode.
Figure 6A:
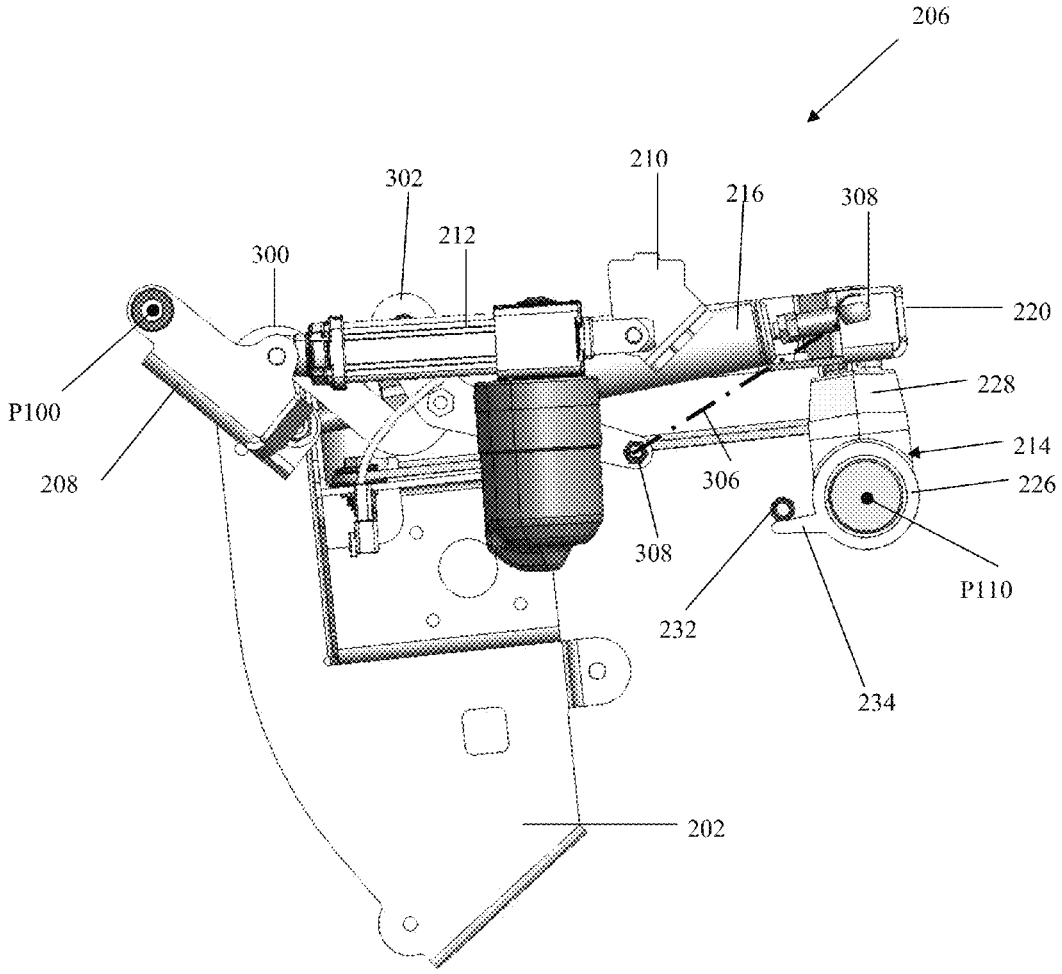
FIG. 6A is a top plan view of a portion of the embodiment of the compact side brush assembly of FIG. 3A shown in the transport mode.
Figure 6B:
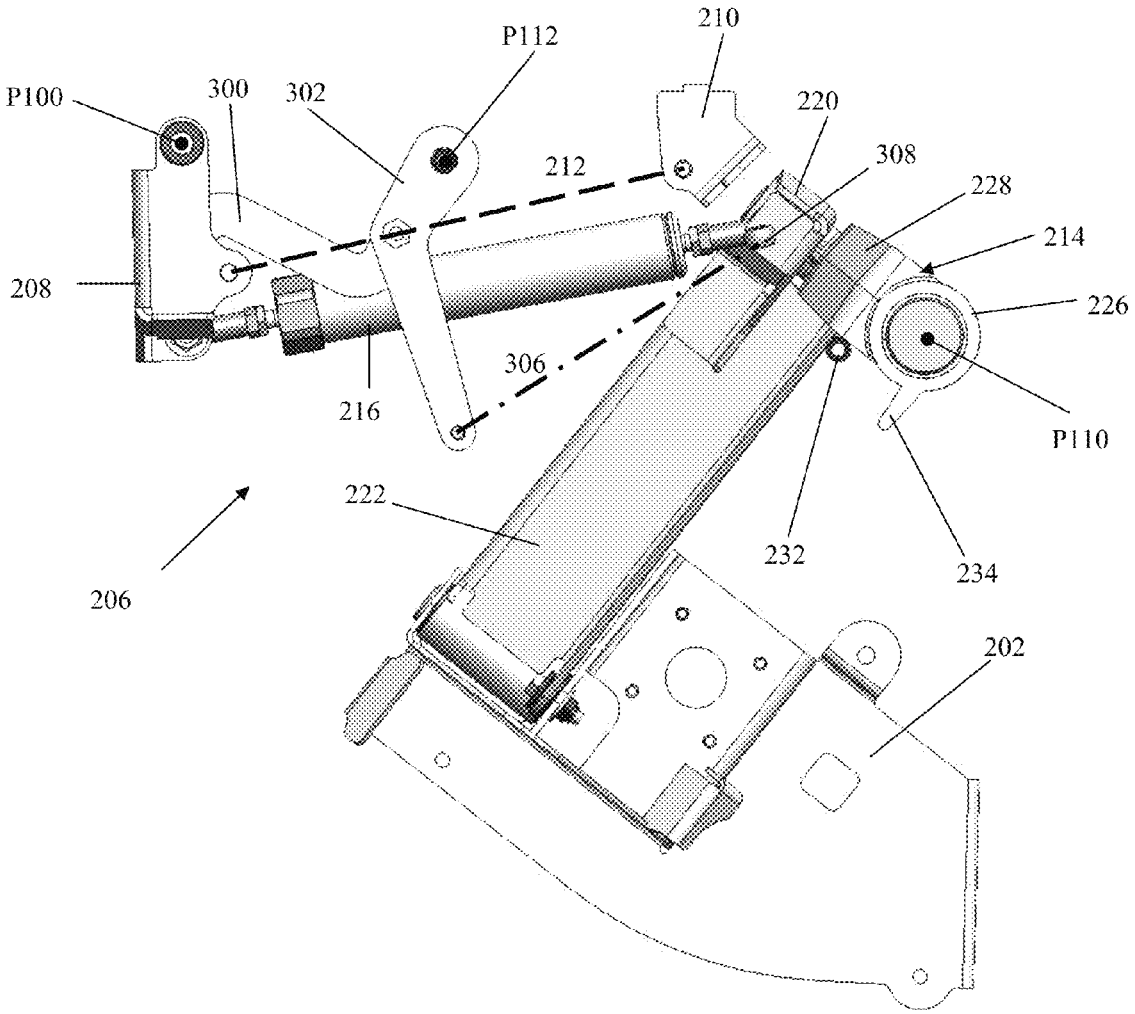
FIG. 6B is a top plan view of a portion of the embodiment of the compact side brush assembly of FIG. 3B shown in the operational mode.
Figure 7A:
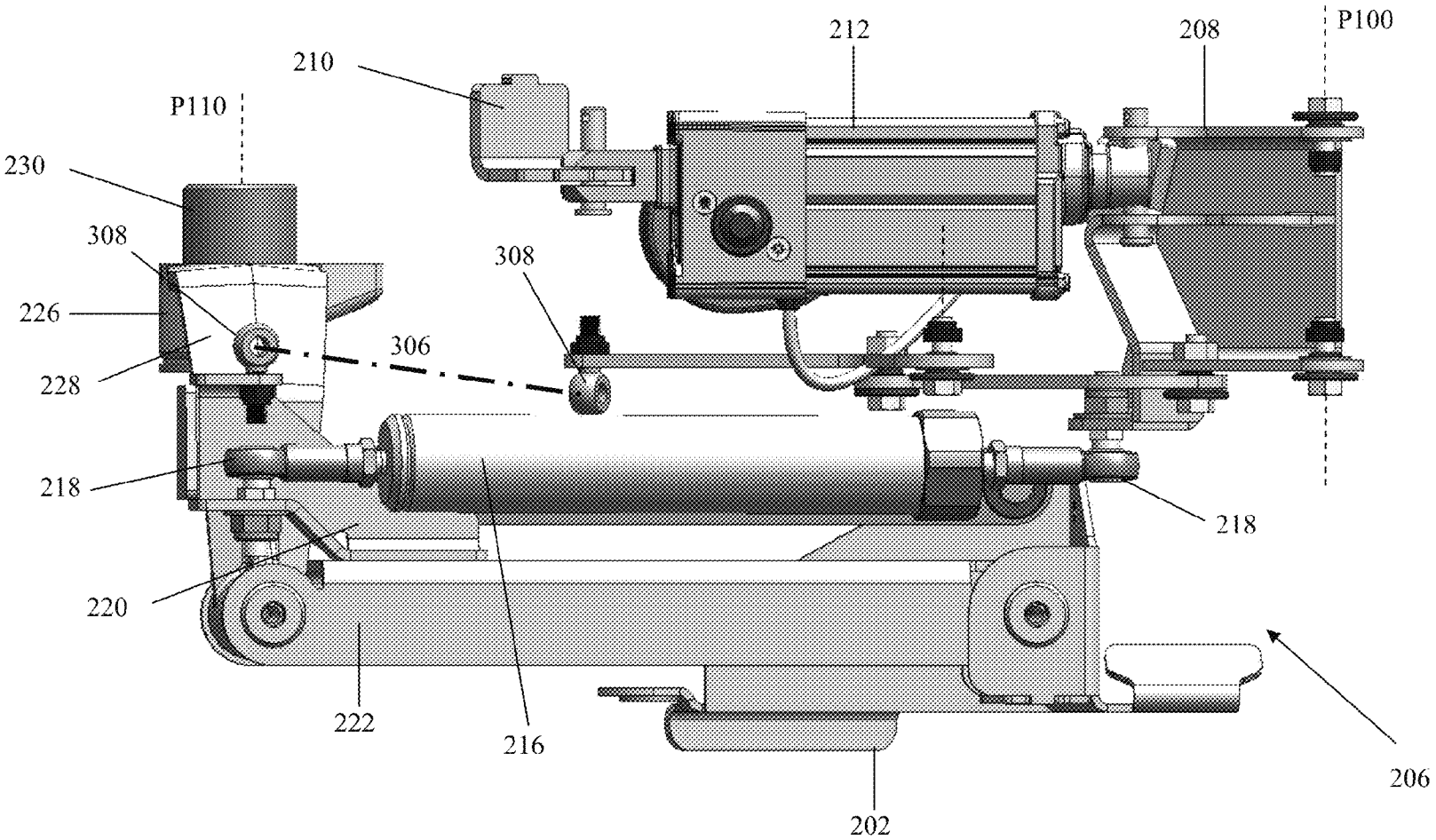
FIG. 7A is a left side elevation view of a portion of the embodiment of the compact side brush assembly of FIG. 3A shown in the transport mode.
Figure 7B:
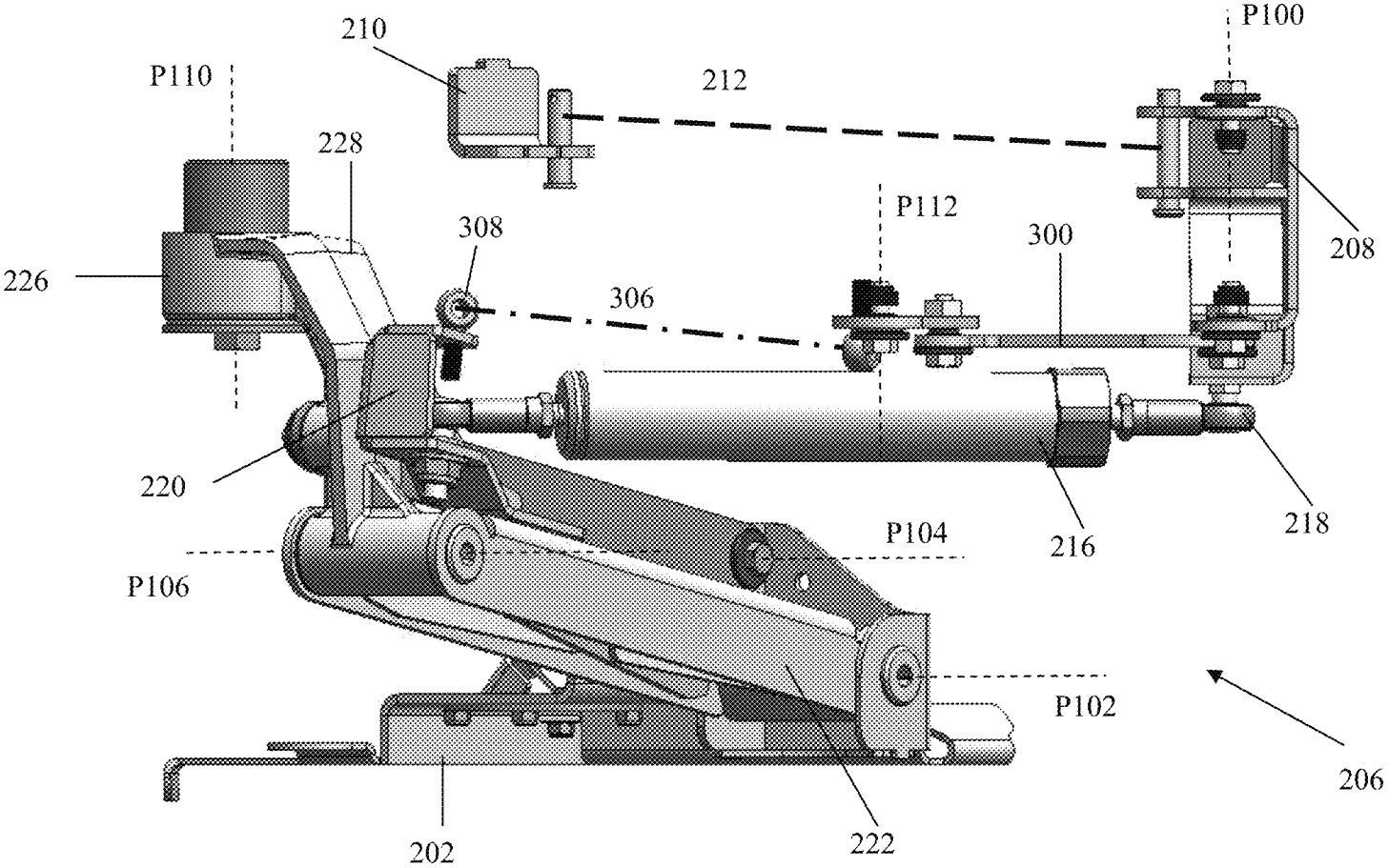
FIG. 7B is a left side elevation view of a portion of the embodiment of the compact side brush assembly of FIG. 3B shown in the operational mode.

FIGS. 4A, 5A, 6A, and 7A are different views of a portion of the embodiment of the compact side brush assembly of FIG. 3A shown in the transport mode. FIGS. 4B, 5B, 6B, and 7B are different views of a portion of the embodiment of the compact side brush assembly of FIG. 3B shown in the operational mode. FIGS. 4A and 4B are right side elevation views. FIGS. 5A and 5B are front elevation views. FIGS. 6A and 6B are top plan views. FIGS. 7A and 7B are left side elevation views.

Referring to FIGS. 3A-7B, unless otherwise indicated, brush deck 202 is attached to frame 200 by a suspension and lift mechanism 206 structure which allows brush deck 202 to be lowered and pivoted outward, to be raised and pivoted inward, and allows the brush 117 to conform to undulations in the floor. Brush deck 202 is attached to frame 200 via a parallel linkage assembly, swing arm 214, slip link 216, frame bracket 208, frame mount 210, linear actuator 212, and associated coupling structures.

One portion of the suspension and lift mechanism 206 includes a frame mount 210 that connects to linear actuator 212 with a pivoted connection that secures the linear actuator to the frame 200 via the pivotable connection to frame mount 210. The other end of linear actuator 212 is extendable and connects to frame bracket 208 with a pivoted connection. As in known in the art, linear actuator includes a leadscrew member having a thread set formed therein and has a distal end which is movable in response to leadscrew rotation. Additional linear actuators may include hydraulic or hybrid electro-hydraulic devices (not shown). The extendable end of leadscrew member has a pin-receiving aperture formed therein. A pin is inserted through an aperture in one end of frame bracket 208 and the pin-receiving aperture of the distal end to secure them together with a pivoted connection. In one embodiment, linear actuator 212 is of a compact design and has a 3.5 inch stroke. In one embodiment, linear actuator 212 is of a compact design and has a stroke less than 4 inches.

As noted above, frame bracket 208 connects to the frame 200 and pivots about frame 200 via a vertical pivot axis P100. Extension or retraction of the linear actuator 212 controls the pivot position of frame bracket 208 about vertical axis P100. As may be seen in FIGS. 3A, 4A, 5A, 6A, and 7A, when the compact side brush assembly 116 of the present invention is in the transport mode, linear actuator 212 is in the short, retracted position in order to pivot frame bracket 208 about vertical axis P100 towards the linear actuator 212. As may be seen in contrast, in FIGS. 3B, 4B, 5B, 6B, and 7B, when the compact side brush assembly 116 of the present invention is in the operational mode, linear actuator 212 is in the long, extended position in order to pivot frame bracket 208 about vertical axis P100 away from the linear actuator 212.

Frame bracket 208 connects to one end of slip link 216. Slip link 216 is a linkage having opposing spherical rod ends 218, providing pivotable connections. The other rod end 218 connects, as will be described further below, to a bracket 220 of a main arm 222. The rod ends 218 of slip link 216 spring biases its rod ends 218 via an internal spring element to retract centrally inward towards each other and shorten the length of the slip link 216. When the rod ends 218 are fully retracted, slip link 216 becomes a rigid link that will transfer or convey a compressive load from one rod end 218 (e.g., from frame bracket 208) to the other rod end 218 (e.g., main arm bracket 220) as a rigid linkage. The fully retracted length of slip 216, as measured by the distance between its rod ends 218 when they are fully retracted centrally inward, is adjustable so as to accommodate different suspension sizes and configurations. As may be seen in FIGS. 3A, 4A, 5A, 6A, and 7A, when the compact side brush assembly 116 of the present invention is in the transport mode, frame bracket 208 has pivoted about vertical axis P100 to compress slip link 216 rod ends 218 such that slip link 216 transfers or conveys compressive load provided by frame bracket 208 from one rod end 218 (e.g., from frame bracket 208) to the other rod end 218 (e.g., main arm bracket 220) as a rigid linkage. As may be seen in contrast, in FIGS. 3B, 4B, 5B, 6B, and 7B, when the compact side brush assembly 116 of the present invention is in the operational mode, frame bracket 208 has pivoted about vertical axis P100 to stretch slip link 216 rod ends 218 against the bias of the internal spring mechanism and lengthen slip link 216. Despite the ability to stretch, rod ends 218 convey a tensile force in the operational mode provided by frame bracket 208 on one rod end 218 (connected to frame bracket 208) that pulls on the other rod end 218 (connected to main arm bracket 220). Since the forces from slip link 216 are applied to main arm 222 via bracket 220, main arm 222 may be reinforced more than second arm 224 in order to handle the loads applied to it as compared to second arm 224. Second arm 224, in contrast, provides a parallel arm in order to keep brush deck 202 level.

As noted above, one of the rod ends 218 connects to a bracket 220 on main arm 222. Main arm 222 and second arm 224 form part of the parallel linkage assembly. Main arm 222 and second arm 224 connect to brush deck 202 via pivoted connections. One of the pivoted connections permits the main arm 222 to pivot relative to the brush deck about a horizontal axis P102. The other pivoted connection permits second arm 224 to pivot relative to brush deck about another, parallel, horizontal axis P104. The parallel linkage assembly provides the up/down motion of the brush deck 202. The parallel geometry of linkage assembly is important to keep brush deck 202 generally level (e.g., horizontal) as the brush deck 202 adjusts to floor contours. Main arm 222 also connects to swing arm 214 via a pivoted connection, having a pivot axis P106 offset from but parallel to pivot axes P102, P104. Second arm also connects to swing arm 214 via a pivoted connection, having a pivot axis P108 offset from and parallel to pivot axis P106 of main arm. As may be seen in FIGS. 3A, 4A, 5A, 6A, and 7A, when the compact side brush assembly 116 of the present invention is in the transport mode, main arm 222 and second arm 224 have pivoted upward, about axes P102, P104, P106, P108, moving brush deck 202 upward with them while keeping brush deck 202 generally level and parallel to the underlying floor. As may be seen in contrast, in FIGS. 3B, 4B, 5B, 6B, and 7B, when the compact side brush assembly 116 of the present invention is in the operational mode, main arm 222 and second arm 224 have pivoted downward, about axes P102, P104, P106, P108, moving brush deck 202 downward with them to contact the underlying floor while keeping brush deck 202 generally level.

As noted above, both main arm 222 and second arm 224 connect to swing arm 214. To the extent that the parallel linkage assembly provides the lift axis (up and down movement) for the brush deck 202, swing arm 214 provides the inward/outward pivot axis for the brush deck 202. More specifically, swing arm 214 pivots about vertical axis P110, thereby also pivoting main arm 222, second arm 224, and most importantly, brush deck 202 inward/outward about vertical axis P110. Swing arm 214 has a hollow cylindrical portion 226 and a leg portion 228 that is either fixed to or integral with swing arm 214 extends from the cylindrical portion 226 such that the leg portion 228 is offset or eccentrically positioned relative to the cylindrical portion 226. Cylindrical portion 226 is journaled about and rotationally supported by a stationary frame shaft 230. Stationary frame shaft 230 is positioned within the hollow cylindrical portion 226 and is connected to frame 200. Vertical axis P110 is located centrally within the cylindrical portion 226 of swing arm 214. Main arm 222 and second arm 224 of the parallel linkage assembly connect to the leg portion 228. The inward and outward rotation of swing arm 214 is limited by stationary stop 232 that is connected to a plate, which is connected to frame 200 (FIGS. 2A, 6A, 6B). Stop 232 can merely be a bolt or other type of physical, limiting component. Referring to FIG. 6A, swing arm 214 has rotated (clockwise in FIG. 6A) until a finger 234, which extends from cylindrical portion 228 of swing arm 214, abuts stop 232. Stop 232, in combination with finger 234, prevents swing arm 214 from rotating further inward. Referring to FIG. 6B, swing arm 214 has rotated (counterclockwise in FIG. 6B) until leg portion 228 of swing arm 214 abuts stop 232. Stop 232, in combination with leg portion 228, prevents swing arms 214 from rotating further outward.

As may be seen in FIGS. 3A, 4A, 5A, 6A, and 7A, when the compact side brush assembly 116 of the present invention is in the transport mode, swing arm 214 has pivoted inward towards the central portion of the vehicle about vertical axis P110, moving main arm 222, second arm 224 and brush deck 202 inward. As may be seen in contrast, in FIGS. 3B, 4B, 5B, 6B, and 7B, when the compact side brush assembly 116 of the present invention is in the operational mode, swing arm 214 has pivoted outward away from the central portion of the vehicle about vertical axis P110, moving main arm 222, second arm 224 and brush deck 202 outward in order to widen the cleaning path of vehicle 100.

As noted above, one rod end 218 of slip link 216 connects to bracket 220 of main arm 222 with a pivoted connection. Also as noted above, in the transport mode, frame bracket 208 has pivoted about vertical axis P100 to compress slip link 216 rod ends 218 such that slip link 216 transfers or conveys compressive load provided by frame bracket 208 from one rod end 218 (e.g., from frame bracket 208) to the other rod end 218 (e.g., main arm bracket 220) as a rigid linkage.

Also as noted above, in the operational mode, frame bracket 208 has pivoted about vertical axis P100 to stretch slip link 216 rod ends 218 against the bias of the internal spring mechanism and lengthen slip link 216 such that rod ends 218 convey a tensile force provided by frame bracket 208 on one rod end 218 (connected to frame bracket 208) that pulls on the other rod end 218 (connected to main arm bracket 220). These forces, either compressive or tensile, are provided at the pivotal connection between rod end 218 and main arm bracket 220. Since the main arm bracket 220 connection to the rod end 218 is spaced away from vertical pivot axis P110 of swing arm 214, the compressive or tensile forces create a moment arm that causes the swing arm 214 to rotate about its vertical pivot axis. Similarly, since the main arm bracket 220 connection to the rod end 218 is spaced away from the pivot (lift) axis of main arm 222, the compressive or tensile forces create a moment arm that causes the main arm 222 to rotate about its pivot axis P106. Thus, when the slip link 216 provides a compressive force during movement to the transport mode, swing arm 214 pivots inward for transportation of brush deck 202 and main arm 222 rotates above pivot axis P106 to lift up brush deck 202. In contrast, when slip link 216 provides a tensile force during movement to the operational mode, swing arm 214 pivots carrying brush deck 202 outward for a wider cleaning path and main arm 222 rotates about pivot axis P106 to push down brush deck 202. Moreover, in certain embodiments, the force that drops brush deck 202 down is great enough to push brush deck (and therefore its underlying brush) against the floor. Such a downward force provides additional scrubbing power for the brush.

In certain embodiments, the inward/outward pivot motion of brush deck is designed to occur with the brush deck in the lower position. That is, when moving from the transport mode to the operational mode, the pivot motion of main arm 222 about lift axis P106 to drop brush deck to the floor surface occurs first, followed by the pivot motion of swing arm 214 about pivot axis to move brush deck outward. Conversely, when moving from the operational mode to the transport mode, the pivot motion of swing arm 214 about pivot axis to move brush deck inward followed by the pivot motion of main arm 222 about lift axis P106 to lift brush deck from the floor surface. Such an order of motions is sometimes preferable such that the brush and its squeegee remain on the floor until they are swung within the boundary of the machine, at which point they are lifted off the floor. Such motion tends to better capture any liquid or debris under brush and direct it towards the main portion of machine for pickup.

As noted above, during movement to the operational mode, slip link 216 provides a tensile force on rod end 218 of bracket 220. The tensile force creates a moment arm that pivots swing arm 214 outward. The outward pivot continues until leg 228 of swing arm 214 abuts stop 232. At that point, swing arm 214 cannot pivot about axis P110 any further outward. Linear actuator 212, in certain embodiments, is designed to continue its extending stroke beyond the point that causes leg 228 to abut stop 232. Accordingly, further actuation of the linear actuator 212 further pivots frame bracket 208 about axis P100. Since such movement does not translate into further outward pivoting of swing arm, the tensile force on slip link 216 results in axial stretching against the spring bias of slip link 216 resulting in a lengthening of slip link 216 between its rod ends 218. Moreover, the continuing tensile force on slip link 216 maintains the moment arm that wants to rotate main arm 222 about pivot axis P106 to push down brush deck 202, thus resulting in a greater downforce on brush deck 202.

As noted above, during movement to the transport mode, slip link 216 compresses until it is a rigid link and provides a compressive force on rod end 218 of bracket 220. The compressive force creates a moment arm that pivots swing arm 214 inward. The inward pivot continues until finger 234 of swing arm 214 abuts stop 232. At that point, swing arm 214 cannot pivot about axis P110 any further inward. Linear actuator 212, in certain embodiments, is designed to continue its retracting stroke beyond the point that causes finger 234 to abut stop 232. Accordingly, further actuation of the linear actuator 212 further pivots frame bracket 208 about axis P100. Since such movement does not translate into further inward pivoting of swing arm, the compressive force on slip link 216 maintains the moment arm that wants to rotate main arm 222 about pivot axis P106 to pull brush deck 202 upward, thus pulling brush 117 upward from contact with the floor.

As noted above, the force that drops brush deck 202 down is great enough to push brush deck (and therefore its underlying brush) against the floor to provide additional scrubbing power for the brush. In certain embodiments, such as when additional downforce is desired, the suspension and lift mechanism 206 for side brush assembly 116 includes a downforce amplifier assembly that increases or amplifies the downforce on brush deck. For smaller vehicles, the downforce amplifier assembly may be eliminated or not used. The downforce amplifier assembly includes a first intensifier arm 300 and a second intensifier arm 302, and an extension spring 304 (omitted for clarity, but shown in dotted lines to indicate its position and length). First intensifier arm 300 is connected between frame bracket 208 and second intensifier arm 302, both via a pivoted connections. Second intensifier arm 302 is connected to frame 200 via a pivoted connection having a vertical pivot axis P112. A distal end of second intensifier arm 302 has an eyelet 308 through which an end of extension spring 306 is inserted. The other end of extension spring 306 is connected to an eyelet 308 mounted to main arm bracket 220. As may be seen in FIGS. 3A, 4A, 5A, 6A, and 7A, when the compact side brush assembly 116 of the present invention is in the transport mode, frame bracket 208 has pivoted about vertical axis P100 to push first intensifier arm 300 towards second intensifier arm 302. The push from first intensifier arm 300 causes second intensifier arm 302 to rotate about vertical axis, thereby moving eyelet 308 on distal end of second intensifier arm 302 towards the eyelet 308 on main arm bracket 220. Since an extension spring (as opposed to a compression spring) connects these two eyelets 308, extension spring 306 is collapsed and does not convey any significant force to eyelet 308 of main arm bracket 220.

As may be seen in contrast, in FIGS. 3B, 4B, 5B, 6B, and 7B, when the compact side brush assembly 116 of the present invention is in the operational mode, frame bracket 208 has pivoted about vertical axis P100 to pull first intensifier arm 300 away from second intensifier arm 302. The pull from first intensifier arm 300 causes second intensifier arm 302 to rotate about vertical axis, thereby moving eyelet 308 on distal end of second intensifier arm 302 away from the eyelet 308 on main arm bracket 220. Since an extension spring (as opposed to a compression spring) connects these two eyelets 308, extension spring 306 is stretched and conveys a tensile force to eyelet 308 of main arm bracket 220.

Similar to the discussion of moment arms above with respect to the slip link 216, since the eyelet of main arm bracket 220 is spaced away from the pivot (lift) axis P106 of main arm 222, the tensile force creates a moment arm that causes the main arm 222 to rotate about its pivot axis P106. Thus, when extension spring 306 provides a tensile force during movement to the operational mode, main arm 222 rotates about pivot axis P106 to push down brush deck 202. Moreover, since the eyelet 308 of main arm bracket 220 is even further away from pivot axis than is the connection between slip link 216 and main arm bracket, the moment arm created by extension spring 306 is even larger than that of the slip link 216. Thus, the extension spring 306 can provide a substantial downward force to amplify the downward force already provided by slip link 216. Extension spring 306 may also provide additional torque to pivot the brush deck 202 outward since the eyelet of main arm bracket 220 is spaced away from the pivot axis P112 of swing arm 214. The tensile force creates a moment arm that causes the swing arm 214 to rotate about its pivot axis P112. Many types of extension springs 306 may be used. For applications where a larger downforce is desired (e.g., a deeper scrub), an extension spring 306 is a larger spring constant may be employed. However, for applications such as sweeping, where a relatively smaller downforce is desired, a spring with a smaller spring constant may be employed. Moreover, for some sweeping applications that require very little downforce, extension spring could be removed completely, leaving slip link to provide the main downforce.

During use of the vehicle 100 and when the side brush assembly 116 is deployed, slip link 216 also permits brush deck 202 to rise and fall while passing over any undulations in the floor without also requiring actuation of the linear actuator 212. As noted above, when in the operational mode, the rod ends 218 of slip link 216 are stretched. If the brush 117 encounters floor undulations or obstructions, the brush 117 will be pushed upward and/or rearward, which translates to inward movement. In order to accommodate such upward and/or inward forces from undulations or obstructions, slip link 216 will stretch further, via its rod ends 218, against its spring bias to permit limited lift and inward movement. After the undulation and/or obstruction has been traversed, the spring bias of the slip link 216 will pull the rod ends 218, creating a downforce that causes the brush deck to return back to its full down and out operational position. The linear actuator need not be engaged during such process since the slip link can provide the limited movement needed to permit brush deck 202 to rise and fall or pivot inward while passing over any undulations in the floor. In the instance when brush deck encounters dips or valleys in the floor surface, the downforce from one or both of the stretched slip link 216 (from being in the operational mode) or the extension spring will cause the brush deck to rotate downward against the dip or valley to maintain contact with the floor even without any actuation of the linear actuator.

Figure 8:
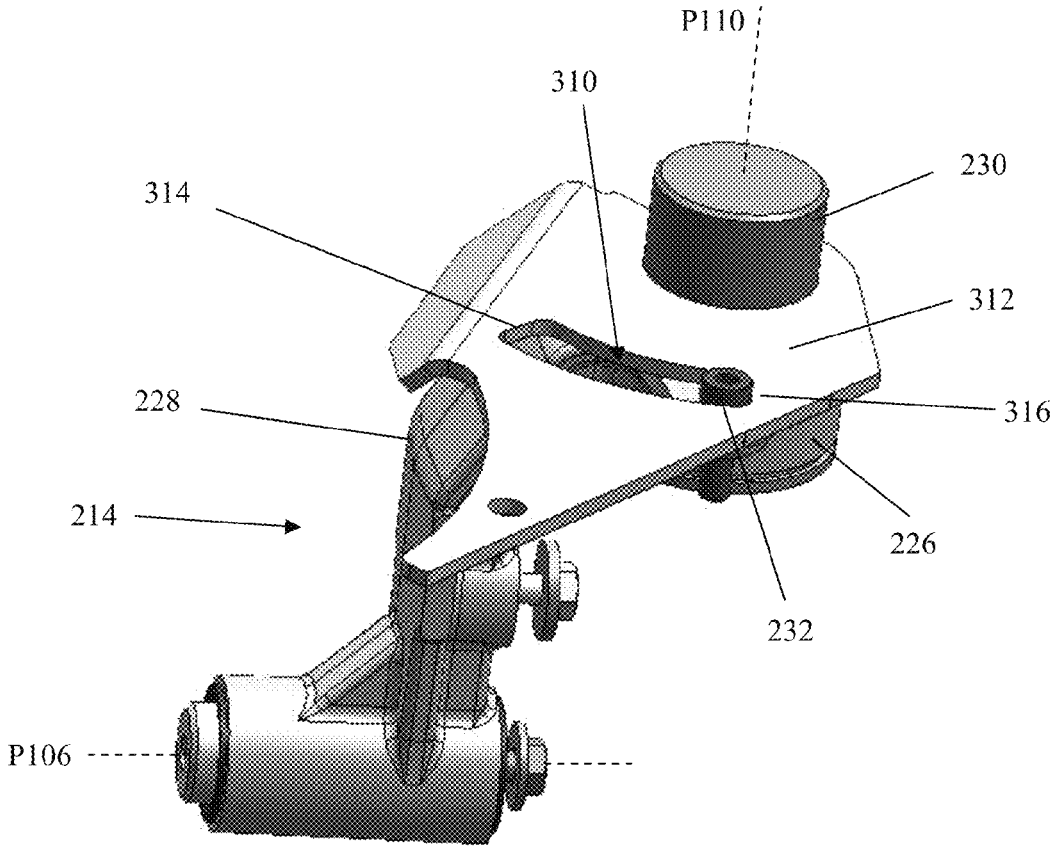
FIG. 8 is a view of an alternate embodiment of a swing arm of the compact side brush assembly.

FIG. 8 is a view of an alternate embodiment of a swing arm of the compact side brush assembly. Unless stated otherwise, the features (and reference numerals) already described for the previous embodiments of the swing arm apply to the embodiment of FIG. 8. Like numerals denote like elements. In earlier embodiments, stationary stop 232 limits the rotation of the swing arm 214 when, in one direction of rotation, the stationary stop 232 abuts finger 234 (FIG. 6A) and, in the other direction of rotation, the stationary stop 232 abuts leg portion 228 of swing arm 214 (FIG. 6B). In the embodiment of FIG. 8, an open slot 310 formed in a shroud 312 of the rotatable cylindrical portion 226 limits rotation of swing arm 214. Shroud 312 is mounted to or is formed with the cylindrical portion 226, such that shroud 312 rotates with the clockwise or counter-clockwise rotation of the swing arm 214, as described previously. Slot 310 is arcuate. Stationary stop 232 remains in slot 310 as swing arm 214 and its shroud 312 rotate. As shown in FIG. 8, swing arm 214 has rotated (similar to FIG. 6A) until a first end 314 of slot 310 abuts stop 232. Stop 232, in combination with the first end 314 of slot 310, prevents swing arm 214 from rotating further inward. If swing arm rotates the other direction (similar to FIG. 6B), swing arm 214 will rotate until stop 232 abuts second end 316 of slot 310. Stop 232, in combination with second end 316 of slot 310, prevents swing arm 214 from rotating further outward. Using a slotted shroud, such as that shown in FIG. 8, can provide a higher degree of precision for the end points of swing arm rotation than the embodiment shown in FIGS. 6A and 6B. Slot 310 may be laser cut in shroud 312, whereas the finger 234 and leg portion 228 used in FIGS. 6A and 6B may be cast.

In the foregoing detailed description, the invention has been described with reference to specific embodiments. However, it may be appreciated that various modifications and changes can be made without departing from the scope of the invention.

The invention claimed is:

1. A side brush assembly for a floor surface maintenance machine comprising:

a brush deck carrying a floor-engaging brush;

a parallel linkage assembly pivoting about one or more pivot axes, and thereby supporting the brush deck generally parallel to the floor surface, one of the pivot axes being a lift axis, the pivoting of the parallel linkage assembly about the lift axis raising and lowering the brush deck;

a swing arm adapted to rotate about a swing axis, the swing arm being connected to the parallel linkage assembly, the pivoting of the swing arm about the swing axis swinging the brush deck towards and away from the floor surface maintenance machine; and an actuator assembly, including a linear actuator and a slip link, the slip link being a linkage comprising a spring housed internally therewithin the actuator assembly, when actuated, pivots the parallel linkage assembly about the lift axis and pivots the swing arm about the swing axis to move the brush deck to a transport mode or an operational mode, the parallel linkage assembly being connected to one end of the slip link at a position other than along the lift axis and the swing axis, the slip link transmitting a tensile or a compressive force to the connection of the parallel linkage assembly and the one end of the slip link such that the pivoting of the parallel linkage assembly about the lift axis occurs independent of the pivoting of the swing arm about the swing axis.

2. The side brush assembly of claim 1, wherein the slip link is adapted to stretch axially from a fully retracted length to elongated lengths, the internal spring housed in the slip link permitting the slip link to be spring biased to axially shorten from the elongated lengths to the fully retracted length.

3. The side brush assembly of claim 2, wherein, at the fully retracted length, the slip link becomes a rigid link that conveys a compressive load from a first end of the slip link to a second end of the slip link.

4. The side brush assembly of claim 2, wherein, in the transport mode, the slip link is at the fully retracted length, conveying a compressive load adapted to hold the parallel linkage assembly at an upward pivot position about the lift axis above the underlying floor and to hold the swing arm at an inward rotational orientation about the swing axis towards the floor surface maintenance machine.

5. The side brush assembly of claim 2, wherein, in the operational mode, the slip link conveys a tensile load adapted to hold the parallel linkage assembly at a downward pivot position about the lift axis towards the underlying floor and to hold the swing arm at an outward rotational orientation about the swing axis away from the floor surface maintenance machine.

6. The side brush assembly of claim 5, wherein, in the operational mode, the slip link is stretched axially to an elongated length, the slip link being spring biased to axially shorten from the elongated lengths to a fully retracted length, the spring bias of the slip link forcing the parallel linkage assembly towards a downward pivot about the lift axis, thereby forcing the brush deck and the brush towards the underlying floor.

7. The side brush assembly of claim 5, wherein, in the operational mode, the slip link is stretched axially to an elongated lengths, the slip link being spring biased to axially shorten from the elongated lengths to a fully retracted length, the axially stretching of the slip permitting the brush deck and brush to rise and fall when passing over obstructions and low spots on the underlying floor.

8. The side brush assembly of claim 2, wherein the spring bias urges the brush deck and the brush downward to the floor after the brush passes over obstructions on the underlying floor.

9. The side brush assembly of claim 1, wherein, when actuated, the actuator assembly pivots the swing arm about the swing axis to move the brush deck inward towards, or outward away from, the floor surface maintenance machine when the parallel linkage assembly is at a downward pivot position about the lift axis towards the underlying floor, thereby the inward and outward pivot of the brush occurs with the brush against the underlying floor.

10. The side brush assembly of claim 9, wherein, when moving from the transport mode to the operational mode, the pivot motion of the parallel linkage assembly about the lift axis that drops the brush deck to the floor surface occurs first, followed by the pivot motion of swing arm about the swing axis to move brush deck outward.

11. The side brush assembly of claim 9, wherein, when moving from the operational mode to the transport mode, the pivot motion of the swing arm about the swing axis that moves the brush deck inward occurs first, followed by the pivot motion of the parallel linkage assembly about the lift axis to lift brush deck from the floor surface.

12. The side brush assembly of claim 1, wherein rotation of the swing arm is limited by a stationary stop operatively connected to a frame of the floor surface maintenance machine.

13. The side brush assembly of claim 12, wherein the swing arm includes a rotatable cylindrical portion and a leg portion eccentrically positioned relative to the cylindrical portion, and a stationary frame shaft supporting the rotation of the cylindrical portion.

14. The side brush assembly of claim 13, wherein rotation in one direction is limited when a finger protruding from the rotatable cylinder rotates against the stop.

15. The side brush assembly of claim 13, wherein rotation in one direction limited when the leg portion rotates against the stop.

16. The side brush assembly of claim 13, wherein the cylindrical portion includes a shroud with an arcuate slot within which the stationary stop is received, the rotation of the swing arm in either direction being limited when an end of the slot rotates against stop.

17. The side brush assembly of claim 1, wherein the parallel linkage assembly includes two, parallel suspension arms, the two parallel suspension arms including a main arm and a second arm.

18. The side brush assembly of claim 17, wherein the two, parallel suspension arms each connect between the brush deck via connections that permit pivoting about parallel, generally horizontal lift axes.

19. The side brush assembly of claim 18, further comprising a bracket attached to the main arm, and the slip link being attached to bracket, the main arm being reinforced more than second arm since forces force from the slip link are applied to the main arm.

20. The side brush assembly of claim 1, further comprising a downforce amplifier assembly that provides a downforce on the brush deck to push brush deck and the floor-engaging brush against the floor.

21. The side brush assembly of claim 20, wherein the downforce amplifier assembly includes first and second pivotally connected linkages and a compression spring, the second linkage being pivotally connected to the first linkage, to a frame of the floor surface maintenance machine, and to the compression spring.

22. The side brush assembly of claim 1, wherein when in the transport mode, extends outward from the center of the brush no further than 2.5 times the radius of the brush.

23. A side brush assembly for a floor surface maintenance machine, the surface maintenance machine comprising a frame, and wheels for supporting a body, the side brush assembly comprising:

a brush deck;

a floor-engaging brush carried by the brush deck, the brush being cylindrical and defining a radius; and a linear actuator operable to adjust the side brush assembly to an operational mode and a transport mode, when in the transport mode, the entire side brush assembly is positioned to one side of a plane extending through the longitudinal centerline of the frame and below a generally planar major top surface of the frame wherein, in the operating mode, the side brush assembly extends laterally outside a cleaning envelope defined by the wheels of the machine so as to widen the cleaning envelope of the machine, and the side brush assembly being movable laterally toward the machine to adjust the side brush assembly from the operational mode to the transport mode.

24. The side brush assembly of claim 23, further comprising:

a parallel linkage assembly supporting the brush deck generally parallel to the floor surface, the parallel linkage assembly comprising a first end and a second end opposite to the first end; and a slip link operatively connected to the linear actuator at a first end of the slip link and the parallel linkage at a second end opposite to the first end.

25. The side brush assembly of claim 24, wherein the linear actuator comprises a first end and a second end, the second end of the linear actuator being operatively connected to the first end of the slip link.

26. The side brush assembly of claim 25, wherein in the transport mode, the second end of the slip link is positioned proximal to the first end of the linear actuator.

27. The side brush assembly of claim 24, wherein the parallel linkage assembly comprises a first end and a second end opposite to the first end, the first end of the parallel linkage assembly being connected to the second end of the slip link.

28. The side brush assembly of claim 27, wherein in the transport mode, the second end of parallel linkage assembly is positioned proximal to the first end of the slip link.

29. The side brush assembly of claim 24, wherein the slip link is pivotally connected to the linear actuator at the first end of the slip link.

* * * * *